US009844694B2

(12) United States Patent
Birt

(10) Patent No.: US 9,844,694 B2
(45) Date of Patent: Dec. 19, 2017

(54) WEIGHT DEVICE FOR A PHYSICAL FITNESS ROUTINE

(71) Applicant: Ryan Birt, Epworth, IA (US)

(72) Inventor: Ryan Birt, Epworth, IA (US)

( * ) Notice: Subject to any disclaimer, the term of this patent is extended or adjusted under 35 U.S.C. 154(b) by 0 days.

(21) Appl. No.: 14/756,358

(22) Filed: Sep. 2, 2015

(65) Prior Publication Data

US 2016/0346587 A1 Dec. 1, 2016

Related U.S. Application Data

(60) Provisional application No. 62/070,800, filed on Sep. 5, 2014.

(51) Int. Cl.

| | |
|---|---|
| ***A63B 21/06*** | (2006.01) |
| ***A63B 21/072*** | (2006.01) |
| ***A63B 23/12*** | (2006.01) |
| ***A63B 21/00*** | (2006.01) |
| *A63B 23/02* | (2006.01) |
| *A63B 23/035* | (2006.01) |
| *A63B 23/04* | (2006.01) |
| *A63B 23/00* | (2006.01) |

(52) U.S. Cl.

CPC ..... *A63B 21/072* (2013.01); *A63B 21/4035* (2015.10); *A63B 23/03525* (2013.01); *A63B 23/1209* (2013.01); *A63B 21/0607* (2013.01); *A63B 21/0724* (2013.01); *A63B 21/0726* (2013.01); *A63B 23/0205* (2013.01); *A63B 23/03508* (2013.01); *A63B 23/0405* (2013.01); *A63B 23/1218* (2013.01); *A63B 23/1236* (2013.01); *A63B 2023/003* (2013.01); *A63B 2208/0204* (2013.01); *A63B 2208/0238* (2013.01); *A63B 2208/0252* (2013.01); *A63B 2210/50* (2013.01)

(58) Field of Classification Search

CPC . A63B 21/4035; A63B 21/072; A63B 21/075; A63B 21/06; A63B 23/12; A63B 21/0724; A63B 21/4043; A63B 21/0726; A63B 23/1209; A63B 2023/0411; A63B 21/0722; A63B 2210/50; A63B 21/0442; A63B 21/0628; A63B 21/0728

USPC ..... 482/93

See application file for complete search history.

(56) References Cited

U.S. PATENT DOCUMENTS

| | | | |
|---|---|---|---|
| 2,528,213 | A | 10/1950 | Dantolan |
| D227,549 | S | 7/1973 | Alissandratos |
| 4,515,364 | A | 5/1985 | Rotella |

(Continued)

*Primary Examiner* — Andrew S Lo

(74) *Attorney, Agent, or Firm* — Paul M. Denk

(57) ABSTRACT

A versatile weight device for physical fitness routines is disclosed which comprises a plate having a generally H-shaped body having a first leg having an end having a hand grip portion, a second leg having an end having a hand grip portion, a third leg having an end having a hand grip portion, a fourth leg having an end having a hand grip portion, a first handle spanning between the first leg and the fourth leg, a second handle spanning between the second leg and the third leg, a central bore, a first cutout section formed between the first leg, the first handle, and the fourth leg, a second cutout section formed between the first leg and the second leg, a third cutout section formed between the second leg, the second handle, and the third leg, and a fourth cutout section formed between the third leg and the fourth leg.

19 Claims, 11 Drawing Sheets

(56) References Cited

U.S. PATENT DOCUMENTS 4,575,074 A * 3/1986 Damratoski ..... A63B 21/0602 482/93
4,714,246 A * 12/1987 Parisien ..... A63B 67/20 273/330
D299,373 S * 1/1989 Parker ..... D21/682
D302,195 S * 7/1989 Orak ..... D21/682
4,880,229 A 11/1989 Broussard
5,137,502 A * 8/1992 Anastasi ..... A63B 21/072 482/105
D354,322 S * 1/1995 Vodhanel, Jr ..... D21/681
D355,007 S * 1/1995 Rojas ..... D21/681
5,681,243 A * 10/1997 Criss ..... A63B 23/16 482/49
5,692,996 A * 12/1997 Widerman ..... A63B 21/072 482/106
D406,183 S * 2/1999 Zovich ..... D21/680
D409,695 S * 5/1999 Rojas ..... D21/680
D421,076 S * 2/2000 Lincir ..... D21/681
D424,639 S * 5/2000 Rojas ..... D21/680
D433,721 S * 11/2000 Rojas ..... D21/680
D434,090 S * 11/2000 Wallace ..... D21/680
D439,290 S * 3/2001 Rojas ..... D21/680
D445,854 S * 7/2001 Harms ..... D21/680
D450,361 S * 11/2001 Harms ..... D21/680
D451,160 S * 11/2001 Rojas ..... D21/680
6,319,176 B1 * 11/2001 Landfair ..... A63B 21/06 482/106
D454,167 S * 3/2002 Lincir ..... D21/680
D462,729 S * 9/2002 Lawson ..... D21/680
D474,517 S 5/2003 Harms
D483,083 S * 12/2003 Allshouse ..... D21/680
6,736,765 B2 * 5/2004 Wallace ..... A63B 21/072 482/106
D566,209 S * 4/2008 Alessandri ..... D21/681
D639,874 S 6/2011 Hillson
D673,230 S 12/2012 Qin
D684,224 S * 6/2013 Davies, III ..... D21/680
D688,759 S * 8/2013 Davies, III ..... D21/680
D698,400 S 1/2014 Potts
D713,905 S 9/2014 Tang et al.
D731,006 S * 6/2015 Birt ..... D21/680
D749,177 S * 2/2016 Childs ..... D21/682
D751,157 S * 3/2016 Irwin ..... D21/680
D752,160 S * 3/2016 Widerman ..... D21/684
2001/0049324 A1 12/2001 Wallace et al.
2006/0073948 A1 * 4/2006 Lincir ..... A63B 21/06 482/94
2006/0172070 A1 * 8/2006 Cao ..... B41M 7/0027 427/258
2006/0211547 A1 * 9/2006 Lien ..... A63B 21/0728 482/93
2007/0184943 A1 * 8/2007 Davies ..... A63B 21/0724 482/93
2010/0248913 A1 * 9/2010 Dickerson ..... A63B 21/0615 482/104
2012/0094810 A1 * 4/2012 Anderson ..... A63B 21/0724 482/107
2014/0024504 A1 * 1/2014 Potts ..... A63B 21/4035 482/106

* cited by examiner

WEIGHT DEVICE FOR A PHYSICAL FITNESS ROUTINE

CROSS REFERENCE TO RELATED APPLICATION

This application is a non-provisional application upon the provisional filed under Ser. No. 62/070,800, filed on Sep. 5, 2014; and this application is a continuation-in-part of the U.S. patent application Ser. No. 29/463,164, filed on Aug. 16, 2013 now U.S. Pat. No. D731,006.

FIELD OF THE DISCLOSURE

This disclosure generally relates to physical fitness equipment, and more particularly to a weight device for performing traditional exercises and new physical fitness routines.

BACKGROUND OF THE INVENTION

Barbells and dumbbells are used by an individual to during exercise routines in an attempt to increase muscle mass and strength of the individual. It is also known to use a weighted plate to exercise with to increase muscle mass and strength. Although such devices are useful, they suffer from not being able to provide a wide range of motion when using the device. In particular, there are various exercises that an individual should perform during a routine. However, due to the configuration of the barbells, dumbbells, or plates, the individual is not able to perform a particular exercise, or to perform the multitude of exercises required. It may also be necessary to switch between barbells, dumbbells, and plates during an exercise routine. As can be appreciated, this may increase the time of an exercise routine due to the individual having to switch various devices during the various exercise routines. In view of this, it would be advantageous to provide a weight device for performing a physical fitness routine which provides a wide range of motion during use of the weight device. It would further be desirable to have a weight device for performing a physical fitness routine that can be used during an entire exercise routine.

The present disclosure is designed to obviate and overcome many of the disadvantages and shortcomings experienced with weight plate devices. Moreover, the present disclosure is related to a weight device for physical fitness routines in which an individual may perform numerous exercises. Further, the present disclosure is related to a weight device for physical fitness routines that allows the weight device to used with innovated exercises that previously have not been available.

Various prior art patents that relate to this subject matter of the current invention can be seen in the United States patent to Anastasi, U.S. Pat. No. 5,137,502, entitled Weight for Physical Fitness having an Integrally Made Handle.

Related type of weights can be seen in the U.S. Pat. No. 5,692,996, to Widerman, entitled Sculpted Weight for Physical Fitness Routines.

The design patent to Zovich, U.S. Pat. No. Des. 406,183, shows another weight lifting plate.

Another weight plate is shown in the U.S. Pat. No. Des. 450,361, to Harms, et al.

Other United States patents showing related structures can be seen in U.S. Pat. No. 2,528,213 to Dantolan, U.S. Pat. No. D227,549 to Alissandratos, U.S. Pat. No. 4,515,364 to Rotella, U.S. Pat. No. 4,880,229 to Broussard, U.S. Pat. No. D434,090 to Wallace et al., U.S. Pat. No. D445,854 to Harms et al., U.S. Pat. No. D462,729 to Lawson, U.S. Pat. No. D474,517 to Harms, U.S. Pat. No. D566,209 to Alessandri et al., U.S. Pat. No. D639,874 to Hillson, U.S. Pat. No. D673,230 to Qin, U.S. Pat. No. D698,400 to Potts, U.S. Pat. No. D713,905 to Tang et al., and published application to Wallace et al., No. 2001/0049324.

These are examples of various prior art devices that are available, and are used for weight lifting routines.

SUMMARY OF THE INVENTION

The present disclosure is a weight device for a physical fitness routine which comprises a plate having a generally H-shaped body having a first leg having an end including a hand grip portion, a second leg having an end having a hand grip portion, a third leg having an end having a hand grip portion, a fourth leg having an end also including a hand grip portion, a first handle spanning between the first leg and the fourth leg, a second handle spanning between the second leg and the third leg, a central bore, a first cutout section formed between the first leg, the first handle, and the fourth leg, a second cutout section formed between the first leg and the second leg, a third cutout section formed between the second leg, the second handle, and the third leg, and a fourth cutout section formed between the third leg and the fourth leg. All of these are integrated into a singular structure.

In another form of the present disclosure, a weight device for a physical fitness routine comprises a plate having a central portion having a first leg having an end having a first hand grip portion, a second leg having an end having a second hand grip portion, a third leg having an end having a third hand grip portion, a fourth leg having an end having a fourth hand grip portion, a first extension portion adjacent to the first leg, a second extension portion adjacent to the second leg, a third extension portion adjacent to the third leg, and a fourth extension portion adjacent to the fourth leg, and a central bore, a first handle spanning between the first leg and the fourth leg, a second handle spanning between the second leg and the third leg, a first cutout section formed between the first leg, the first handle, and the fourth leg, a second cutout section formed between the first leg and the second leg, a third cutout section formed between the second leg, the second handle, and the third leg, and a fourth cutout section formed between the third leg and the fourth leg, first hand cutout formed between the first handle, the first extension portion, the central portion, and the fourth extension portion, and a second hand cutout formed between the second handle, the second extension portion, the central portion, and the third extension portion.

In yet another form of the present disclosure, a weight device for a physical fitness routine is disclosed which comprises a plate having a generally H-shaped body having a first leg having an end having a first hand grip portion, a second leg having an end having a second hand grip portion, a third leg having an end having a third hand grip portion, a fourth leg having an end having a fourth hand grip portion, a first handle spanning between the first leg and the fourth leg, a second handle spanning between the second leg and the third leg, a central bore, a first cutout section formed between the first leg, the first handle, and the fourth leg, a second cutout section formed between the first leg and the second leg, a third cutout section formed between the second leg, the second handle, and the third leg, and a fourth cutout section formed between the third leg and the fourth leg, the body having a first thickness and the first hand grip having a second thickness with the second thickness being greater than the first thickness.

In light of the foregoing comments, it will be recognized that the present disclosure provides a weight device for performing a physical fitness routine or various and many physical fitness routines.

The present disclosure provides a weight device for a physical fitness routine that allows freedom of motion when performing one or more exercises.

The present disclosure also provides a weight device for a physical fitness routine that allows different weights to be used during various exercises.

The present disclosure further provides a weight device for a physical fitness routine that may be securely held by an individual in various positions during various exercises.

The present disclosure provides a weight device for a physical fitness routine that may be easily transported, stored, and displayed for use.

The present disclosure provides a weight device for a physical fitness routine that is of unitary construction and can be used to obtain increased muscle mass and strength.

The present disclosure is also directed to a weight device for a physical fitness routine that can be grasped with two hands at various positions on the weight device for easy control and movement of the weight device.

The present disclosure provides a weight device for a physical fitness routine that is not bulky, is inexpensive, and enables an individual to exercise various muscle groups.

The present disclosure is also directed to a weight device for a physical fitness routine that may be used alone or in combination with barbells and dumbbells.

The present disclosure provides a weight device for a physical fitness routine that allows the weight device to be used for an entire routine without having to switch to another device or having to put down the weight device to attempt different and many routines or exercises.

The present disclosure is further directed to a weight device for a physical fitness routine that is provided in different weights or increments of weights so that an individual can use a heavier weight device to increase muscle mass and strength.

This invention also is for use for performing a variety of physical fitness routines, in order to exercise and strengthen select muscle groups of the body, so as to provide an overall weight training program utilizing the singular weight device of this invention, to achieve a plurality of exercises, from a singular device, that may be routinely performed, in sequence, when undertaking an exercising program.

These and other advantages of the present disclosure will become apparent to those skilled in the art after considering the following detailed specification in conjunction with the accompanying drawings.

BRIEF DESCRIPTION OF THE DRAWINGS

FIGS. 27A-28B are schematic views of an individual using the weight device for a physical fitness routine such as a curling exercise routine;

FIGS. 28A-28B are schematic views of an individual using the weight device for a physical fitness routine such as a curling exercise routine.

DETAILED DESCRIPTION OF PREFERRED EMBODIMENTS

Figure 1:
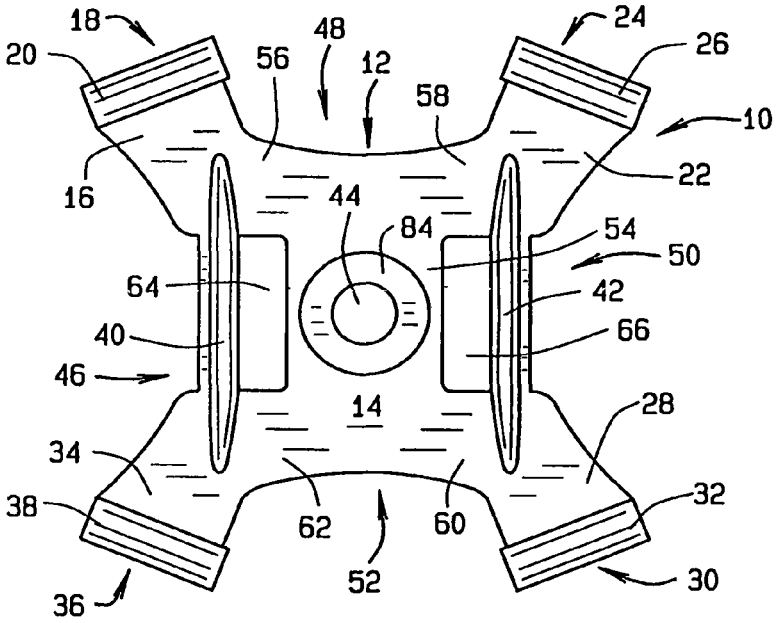
FIG. 1 is a front view of a weight device for a physical fitness routine constructed according to the present disclosure.

Referring now to the drawings, wherein like numbers refer to like items, number 10 identifies a preferred embodiment of a weight device for a physical fitness routine constructed according to the present disclosure. With reference now to FIG. 1, the weight device 10 comprises a plate 12 having a generally H-shaped body 14 having a first leg 16 having an end 18 having a first hand grip portion 20; a second leg 22 having an end 24 having a second hand grip portion 26; a third leg 28 having an end 30 having a third hand grip portion 32; a fourth leg 34 having an end 36 having a fourth hand grip portion 38; a first handle 40 spanning between the first leg 16 and the fourth leg 34; a second handle 42 spanning between the second leg 22 and the third leg 28; and a central bore 44. A first cutout section 46 is formed between the first leg 16, the first handle 40, and the third leg 34. A second cutout section 48 is formed between the first leg 16 and the second leg 22. A third cutout section 50 is formed between the second leg 22, the second handle 42, and the third leg 28. A fourth cutout section 52 is formed between the third leg 28 and the fourth leg 34. The cutouts 46, 48, 50, and 52 are used to allow arms, neck, and shoulders of an individual to fit there through to perform various exercises, as will be explained in detail further herein.

The body 12 also has a central portion 54 having a first extension portion 56 adjacent to the first leg 16, a second extension portion 58 adjacent to the second leg 22, a third extension portion 60 adjacent to the third leg 28, and a fourth extension portion 62 adjacent to the fourth leg 34. A first hand cutout 64 is formed between the first handle 40, the first extension portion 56, the central portion 54, and the fourth extension portion 62. A second hand cutout 66 is formed between the second handle 42, the second extension portion 58, the central portion 54, and the third extension portion 60. The cutouts 64 and 66 are generally rectangular in shape, to afford clearance for the hands. The cutouts 64 and 66 allow an individual to wrap hands around the first handle 40 and the second handle 42, respectively. This allows the device 10 to be easily handled or grasped by an individual. The first end 16 is diametrically opposed from the third end 28, and the second end 22 is diametrically opposed from the fourth end 34. The device 10 may be constructed of any metal or steel, and cast therefrom, and may even be coated with a rubber or plastic to cushion the device 10. Portions of the device 10 may be coated or the entire device 10 may be coated. It is also possible and contemplated that different colors of coating may be used to distinguish different weights. By way of example only, a red coating may indicate that the device 10 weighs ten pounds and a blue coating may indicated that the device 10 weighs fifteen pounds.

Figure 2:
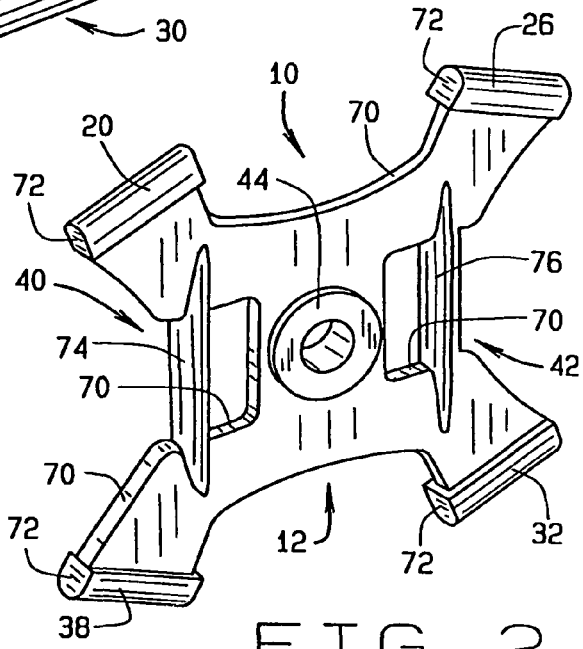
FIG. 2 is a front perspective view of the weight device for a physical fitness routine constructed according to the present disclosure.

FIG. 2 shows a perspective view of the device 10. The body 12 of the device 10 has a first thickness 70 and each of the hand grips 20, 26, 32, and 38 has a second thickness 72. The second thickness 72 is greater than the first thickness 70. This allows an individual to easily grasp the hand grips 20, 26, 32, and 38 of the device 10. The first handle 40 has a third thickness 74 and the second handle 42 has a fourth thickness 76 which is the same of the third thickness 74. The thicknesses 74 and 76 are greater than or thicker than the first thickness 70. Again, this allows an individual to easily grasp the handles 40 and 42 when using the device 10.

Figure 3:
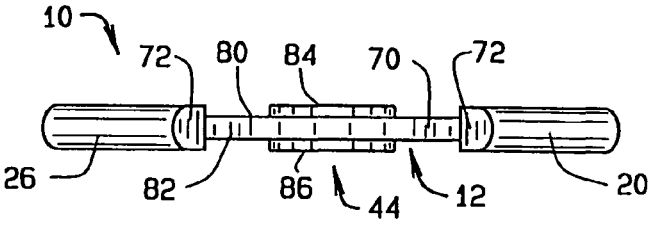
FIG. 3 is a top view of the weight device for a physical fitness routine constructed according to the present disclosure.

With reference now to FIG. 3, a top view of the device 10 is depicted. The body 12 is shown having a front side 80 and a back side 82. The central bore 44 is reinforced by a front reinforcement member 84 and a rear reinforcement member 86. The members 84 and 86 extend out from the front side 80 and the back side 82, respectively. The central bore 44 allows a bar of a barbell or a rod of a dumbbell to pass there thorough for adding weight to the device 10. The reinforcement members 84 and 86 are used so that the device 10 is not damaged when extra weight is added. The first hand grip 20 is shown having the thickness 72 that is thicker than the thickness 70 of the body 12.

Figure 4:
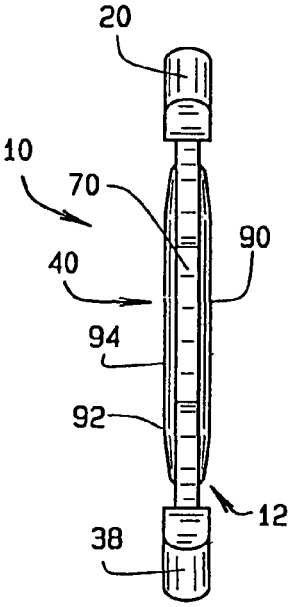
FIG. 4 is a side view of the weight device for a physical fitness routine constructed according to the present disclosure.

FIG. 4 illustrates a side view of the device 10. The device 10 is shown having the handle 40 having a front portion 90 and a back portion 92. The handle 40 has a thickness 94. The thickness 94 of the handle 40 is greater than the thickness 70 of the body 12. This allows the handle 40 to be easily grasped or held during use of the device 10. The handle grips 20 and 38 are also shown in this particular view.

Figure 5A:
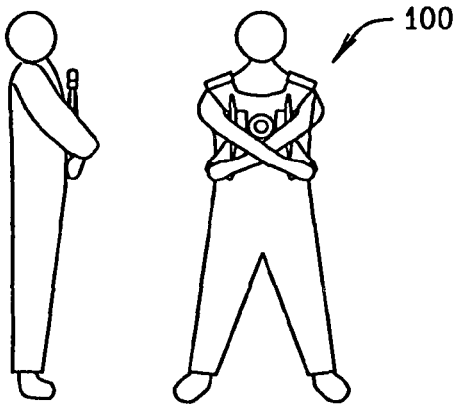
FIGS. 5A-5B are schematic views of an individual using the weight device for a physical fitness routine such as a cross arm (hug) squat routine.
Figure 5B:
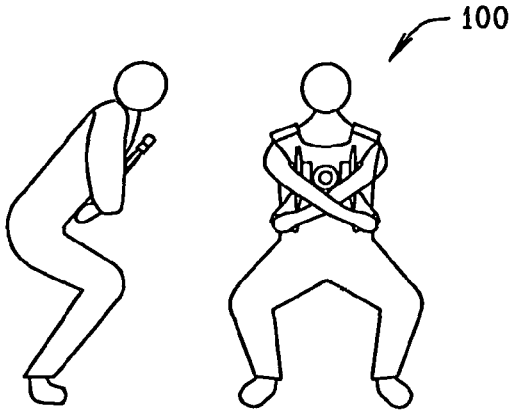

Referring now to FIGS. 5A-5B, an individual 100 is shown using the device 10 to perform a cross arm (hug) squat exercise routine. The individual 100 initially performs the routine while holding the device 10 in a cross arm grip or hug position. The second cutout section 48 allows the head and neck of the individual 100 to fit therein and the first cutout section 46 and the third cutout section 50 allow the arms of the individual 100 to fit through. In this manner, the arms are clasped together to hold the device 10 in place. Once the device 10 is held in place, the individual 100 moves into a squat position, as depicted in FIG. 5B, and the legs of the individual 100 clear the ends 30 and 36 of the device 10. After the squat is completed, the individual 100 stands back up to the initial position to begin another repetition.

Figure 6A:
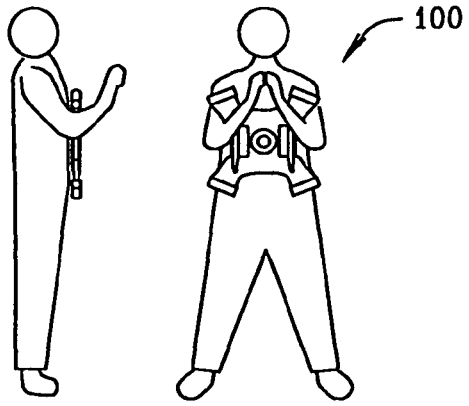
FIGS. 6A-6B are schematic views of an individual using the weight device for a physical fitness routine such as a front squat elbow grip routine.
Figure 6B:
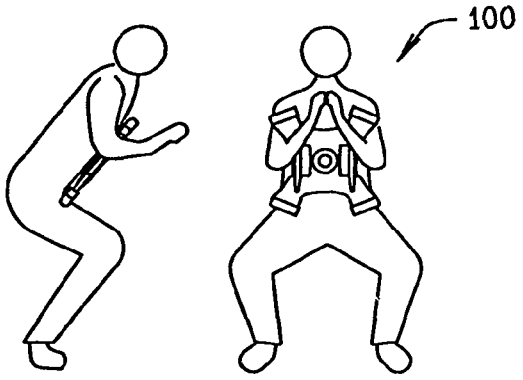

FIGS. 6A-6B illustrate the individual 100 performing a front squat elbow grip exercise routine with use of the device 10. The individual 100 initially places the grips 20 and 26 into each pit of the elbow of each arm. This provides a proper range of motion in performing a front squat movement. The individual 100 then moves into the squat position, as shown in FIG. 6B. Once the squat position is achieved, the individual 100 stands up back into the initial position to begin another repetition.

Figure 7A:
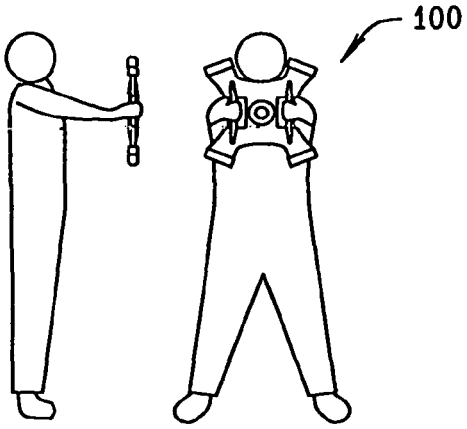
FIGS. 7A-7B are schematic views of an individual using the weight device for a physical fitness routine such as a zombie squat routine.
Figure 7B:
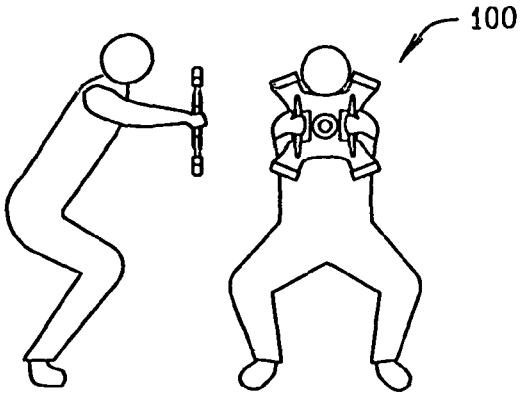

With reference now to FIGS. 7A-7B, a zombie squat routine is illustrated. The device 10 is grasped by the individual 100 by use of the handles 40 and 42 with the arms extended outwardly away from the body. Gripping the handles 40 and 42 in this manner positions the arms at a shoulder width position promoting proper range of motion and maximum core strength. The individual 100 is in an initial upright position holding the device 10. The individual 100 then moves into a squat position still holding the device 10 outwardly (FIG. 7 B). Once the squat is accomplished, the individual returns to the initial position to begin another sequence.

Figure 8A:
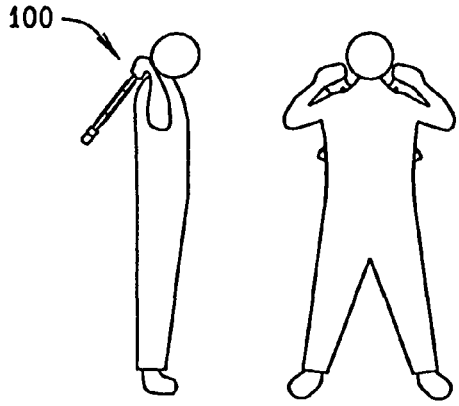
FIGS. 8A-8B are schematic views of an individual using the weight device for a physical fitness routine such as a back squat routine.
Figure 8B:
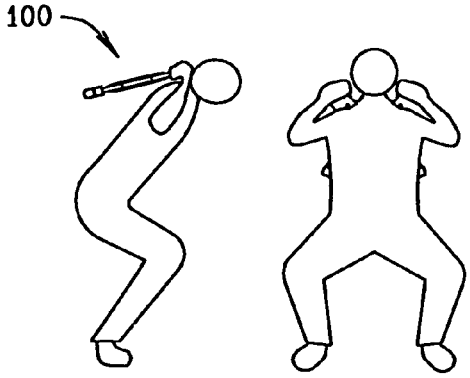

FIGS. 8A-8B show how the device 10 may be used to perform a back squat exercise routine. The individual 100 grasps the device 10 at the grips 20 and 26 with the device 10 placed on the back of the individual 100. The second cutout section 48 allows for proper head position and back alignment. Once the initial position is accomplished, the individual 100 squats with the device 10 positioned on the back of the individual 100, as depicted in FIG. 8B. After the squat is completed, the individual returns to the initial position.

Figure 9A:
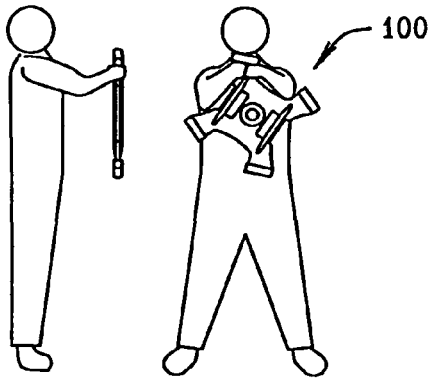
FIGS. 9A-9B are schematic views of an individual using the weight device for a physical fitness routine such as a choke squat routine.
Figure 9B:
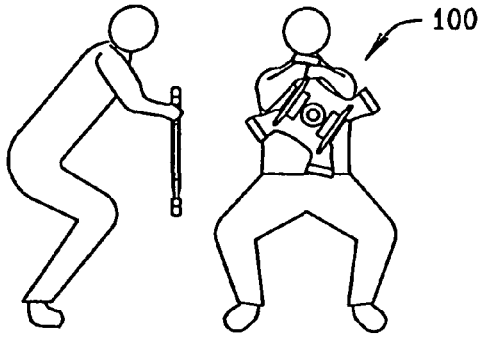

A choke squat exercise routine is shown in FIGS. 9A-9B. The hands of the individual 100 are interlocked around the first leg 16 keeping the elbows in with the arms partially extended. Once this position is completed, the individual 100 moves into a squat position, as shown in FIG. 9B. The cutouts 50 and 52 allow the legs of the individual 100 to move freely during the squat movement. The third leg 28 is also positioned between the legs of the individual 100. The individual 100 may then stand up to complete the choke squat exercise routine.

Figure 10A:
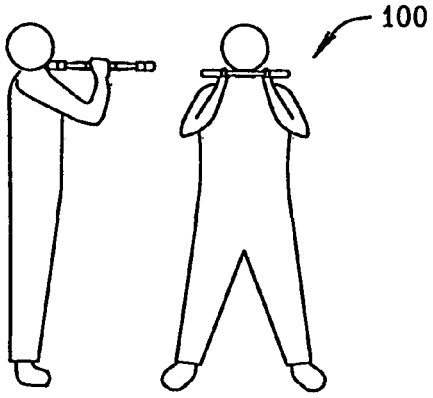
FIGS. 10A-10B are schematic views of an individual using the weight device for a physical fitness routine such as a front squat routine.
Figure 10B:
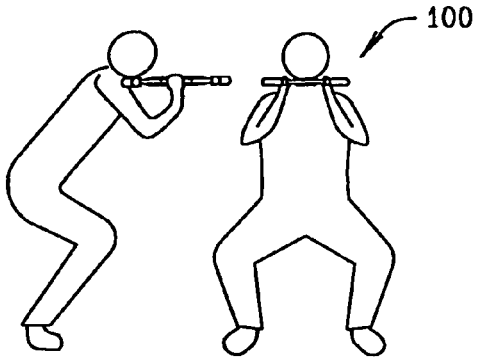

FIGS. 10A-10B depict a front squat exercise routine using the device 10. The individual 100 grips the device 10 by use of the handles 40 and 42 and places the ends 20 and 26 on the shoulders of the individual 100. The second cutout section 48 allows the neck of the individual 100 to fit therein. This provides for proper head and back alignment. The elbows also stay within the core of the body of the individual 100. A deep front squat is then performed as is shown in FIG. 10B. The device 10 allows for proper alignment of the head, back, and core and also allows for a proper range of motion. Once the squat is completed, the individual 100 returns to the initial position.

Figure 11A:
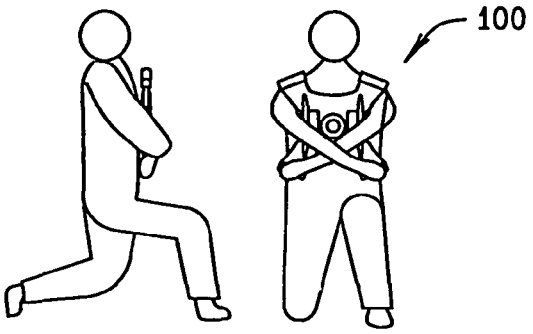
FIGS. 11A-11B are schematic views of an individual using the weight device for a physical fitness routine such as a lunge routine.
Figure 11B:
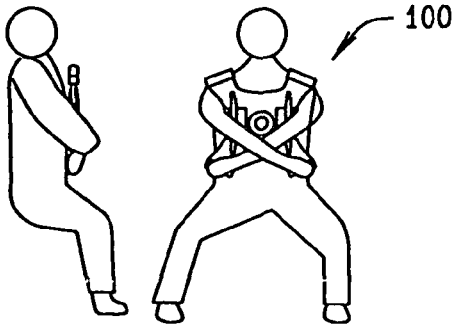

Referring now in particular to FIGS. 11A-11B, the device 10 is shown being used to perform lunges. A cross arm grip or hug of the device 10 is performed by use of the second cutout section 48 that allows the head and neck of the individual 100 to fit therein. The first cutout section 46 and the third cutout section 50 allow the arms of the individual 100 to fit through to hug the device 10. The thigh of one leg of the individual 100 is cleared during the lunge motion. A side lunge motion, as illustrated in FIG. 11B, may also be performed and the first cutout section 48 or the third cutout section 50 do not inhibit movement of the legs during lunges.

Figure 12A:
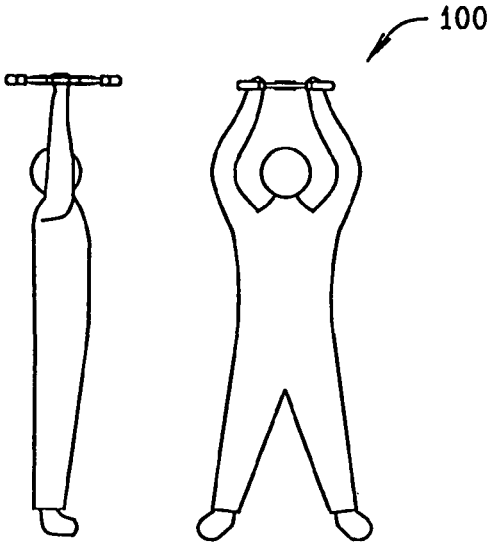
FIGS. 12A-12B are schematic views of an individual using the weight device for a physical fitness routine such as an overhead squat routine.
Figure 12B:
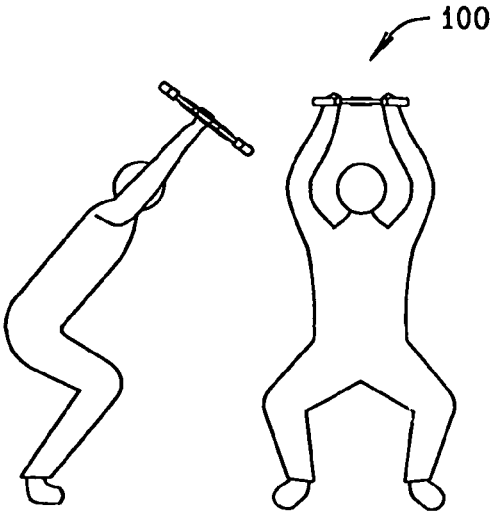

FIGS. 12A-12B depict how an overhead squat may be performed when using the device 10. The handles 40 and 42 are gripped by the individual 100 keeping the hands shoulder width apart and fully extended over head. The individual 100 then squats with the device 10 still over head. The squat motion is shown in FIG. 12B. Once the squat is completed, the individual 100 returns to the initial position.

Figure 13A:
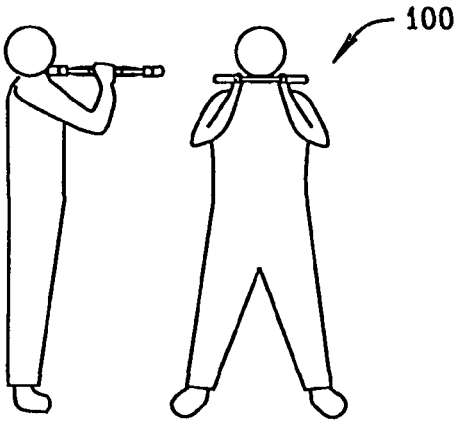
FIGS. 13A-13B are schematic views of an individual using the weight device for a physical fitness routine such as a shoulder press routine.
Figure 13B:
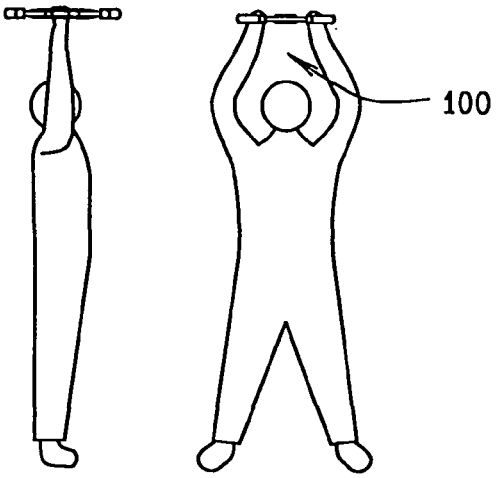

A shoulder press routine may be accomplished by use of the device 10 in the manner shown in FIGS. 13A-13B. In particular, the device 10 is grasped by use of the handles 40 and 42 and the grips 20 and 26 are placed on the shoulders of the individual 100. The second cutout section 48 fits around the neck of the individual 100. This provides for proper form and body position during the shoulder press routine. The device 10 is then lifted above the head with the cutout section 48 clearing the face and head of the individual 100. The device 10 is then returned to the staring position.

Figure 14A:
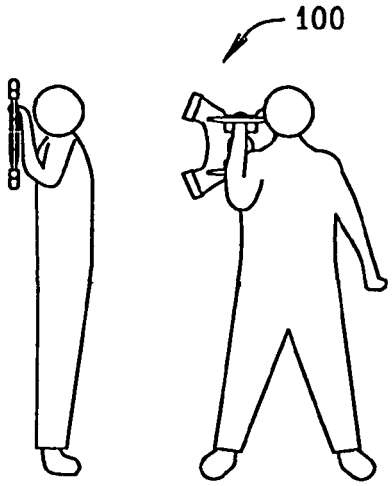
FIGS. 14A-14B are schematic views of an individual using the weight device for a physical fitness routine such as a one arm shoulder press routine.
Figure 14B:
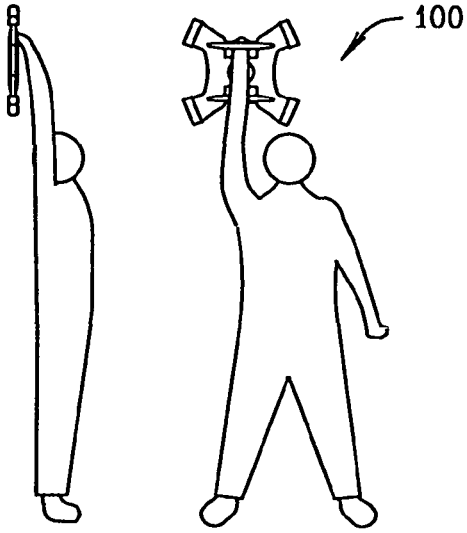

FIGS. 14A-14B demonstrate how the device 10 may be used to perform a one arm shoulder press. The device 10 is grabbed by use of the handle 40 with the grips 26 and 32 facing downwardly. The arm grasping the device 10 is lifted upwardly and then moved back to the initial position to complete one routine of the one arm shoulder press.

Figure 15A:
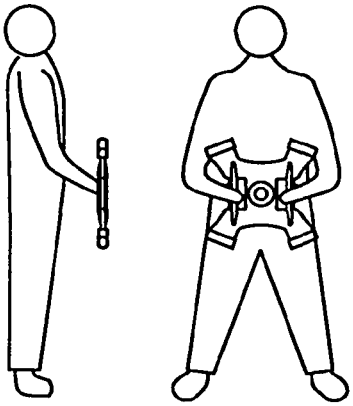
FIGS. 15A-15D are schematic views of an individual using the weight device for a physical fitness routine such as a shoulder complex routine.
Figure 15B:
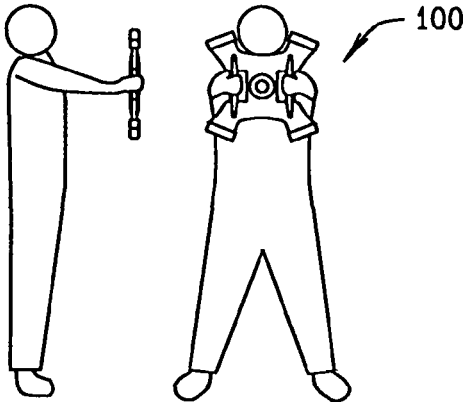
Figure 15C:
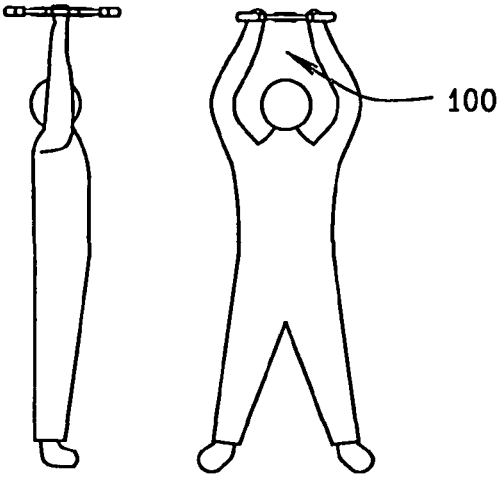
Figure 15D:
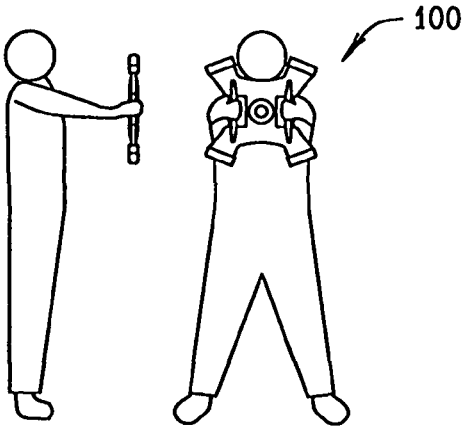
Figure 15E:
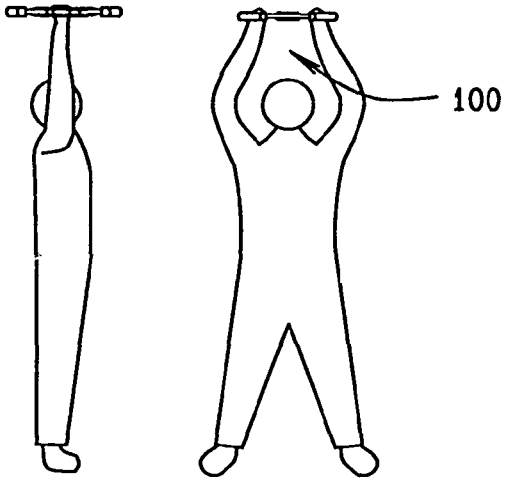
FIG. 15E- is a schematic view of an individual using the weight device for a physical fitness routine such as an overhead extension routine.

With reference now to FIGS. 15A-15D, a shoulder complex routine is shown. Initially, as shown in FIG. 15A, the individual 100 grasps the device 10 by use of the handles 40 and 42 and the arms are extended downwardly. This allows the arms to be placed at shoulder width apart. The device 10 is then moved in front of the individual 100 as depicted in FIG. 15B. In a third step, the device 10 is placed overhead by fully extending the arms upwardly, as in FIG. 15C. Then in a next step shown in FIG. 15D, the device 10 is then moved to a position in which the arms are extended outwardly in front of the individual 100. Finally, the device 10 is again extended overhead, as shown in FIG. 15E.

Figure 16A:
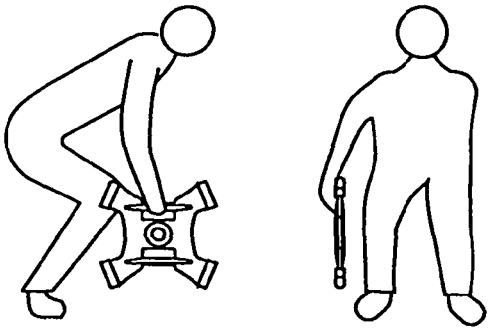
FIGS. 16A-16B are schematic views of an individual using the weight device for a physical fitness routine such as a single arm rows routine.
Figure 16B:
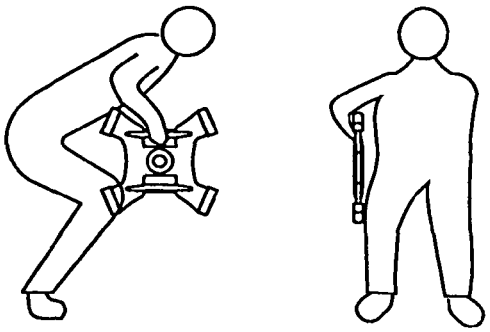

FIGS. 16A-16B depict a single arm rows routine that may be accomplished using the device 10. In an initial step, the handle 40 is grasped and the device is placed at one side of the individual 100 with the arm fully extended downwardly toward the ground. The device 10 is then lifted by moving the arm upwardly. By gripping the handle 40, a balanced and consistent resistance is provided through a proper range of motion of the device 10.

Figure 17A:
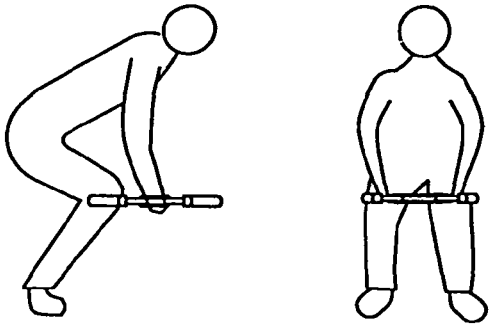
FIGS. 17A-17B are schematic views of an individual using the weight device for a physical fitness routine such as a bent over row routine.
Figure 17B:
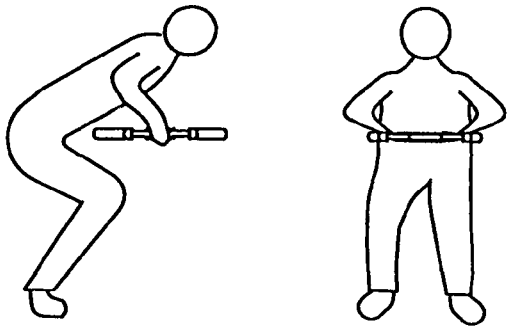

A bent over row exercise routine may be done as is shown in FIGS. 17A-17B. The handles 40 and 42 of the device 10 are grasped with the arms extended downwardly in front of the individual 100, the individual 100 is bent over, and the legs are spread apart. The arms are then moved upwardly to position the device 10 toward the chest and then the device 10 is moved back toward the ground.

Figure 18A:
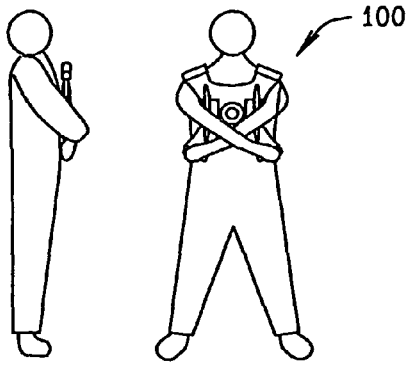
FIGS. 18A-18B are schematic views of an individual using the weight device for a physical fitness routine such as a good mornings routine.
Figure 18B:
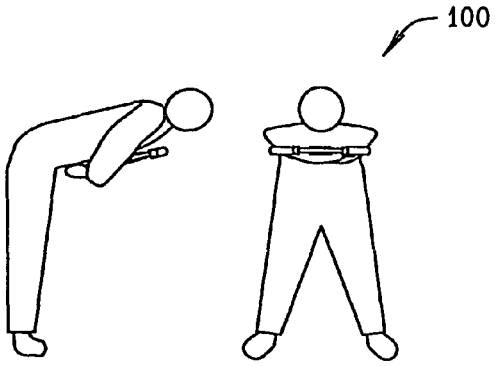

FIGS. 18A-18B illustrate a good mornings exercise routine. The individual 100 initially performs the routine while holding the device 10 in a cross arm grip or hug position. The second cutout section 48 allows the head and neck of the individual 100 to fit therein and the first cutout section 46 and the third cutout section 50 allow the arms of the individual 100 to fit through. In this manner, the arms are clasped together to hold the device 10 in place. Once the device 10 is held in place, the individual 100 bends over while still hugging the device 10. To complete the move, the individual 100 returns to the initial upright position.

Figure 19A:
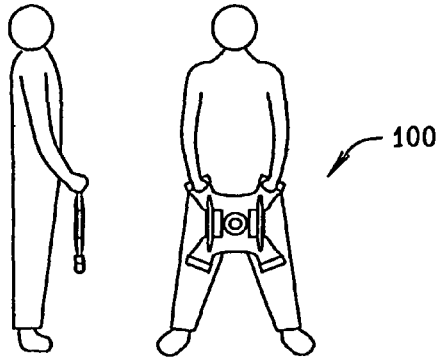
FIGS. 19A-19B are schematic views of an individual using the weight device for a physical fitness routine such as a fat grip upright rows routine.
Figure 19B:
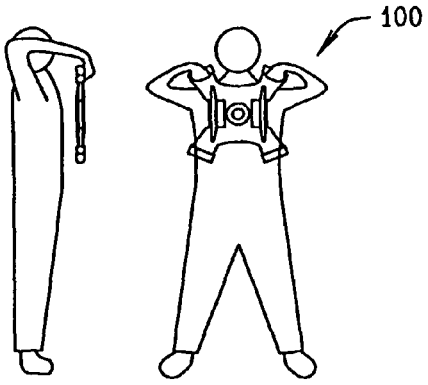

With reference now to FIGS. 19A-19B, a fat grip upright rows routine is shown with use of the device 10. In an initial position, the individual 100 grasps the grips 20 and 26 with the arms fully extended downwardly. The grips 20 and 26 keep the hands shoulder width apart during the routine. The arms are then moved upwardly by extending the elbows outwardly. Once this is completed, the device 10 is brought back to the original position to repeat the exercise.

Figure 20A:
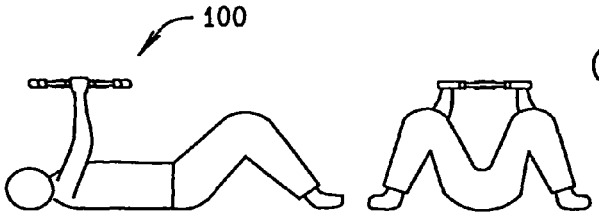
FIGS. 20A-20B are schematic views of an individual using the weight device for a physical fitness routine such as an abdominal exercise routine.
Figure 20B:
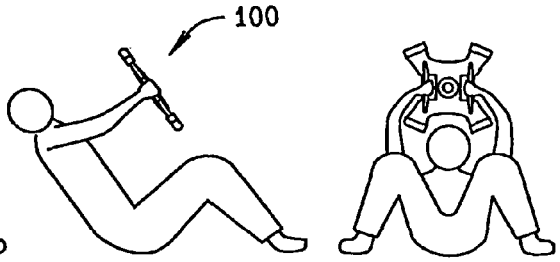

FIGS. 20A-20B illustrate an abdominal exercise that may be executed by use of the device 10. The back of the individual 100 is placed on the floor with the legs in a bent position. The device 10 is then grasped by the handles 40 and 42 and the arms are extended upwardly. The individual 100 then sits up while still holding the device 10. The back of the individual is then returned to the ground.

Figure 21A:
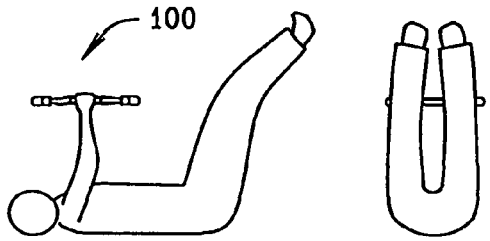
FIGS. 21A-21B are schematic views of an individual using the weight device for a physical fitness routine such as an abdominal exercise routine.
Figure 21B:
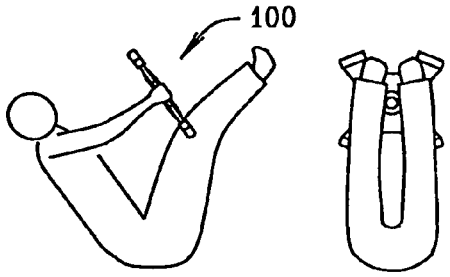

Another variation of an abdominal exercise is shown in FIGS. 21A-21B. This version of the abdominal exercise is initiated by the back of the individual 100 being placed on the ground, the legs extended upwardly, and the individual 100 grasping the device 10 by use of the handles 40 and 42 and extending the arms upwardly. The next movement entails lifting the shoulders off of the ground while still holding the device 10 outwardly from the body. To complete the routine, the shoulders are brought back to the ground.

Figure 22A:
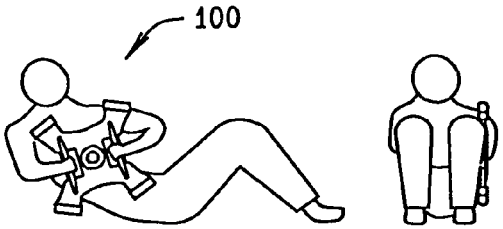
FIGS. 22A-22B are schematic views of an individual using the weight device for a physical fitness routine such as an abdominal exercise routine.
Figure 22B:
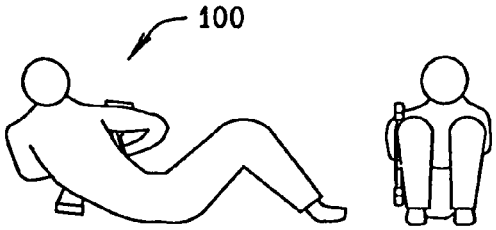

A third variation of an abdominal exercise is illustrated in FIGS. 22A-22B. The individual 100 is sitting on the ground while grasping the device 10 by the handles 40 and 42 at one side of the individual 100. The legs are lifted off of the floor and the device 10 is moved to the other side of the body in a twisting motion. The device 10 is then moved back to the other side of the body in the same twisting motion.

Figure 23A:
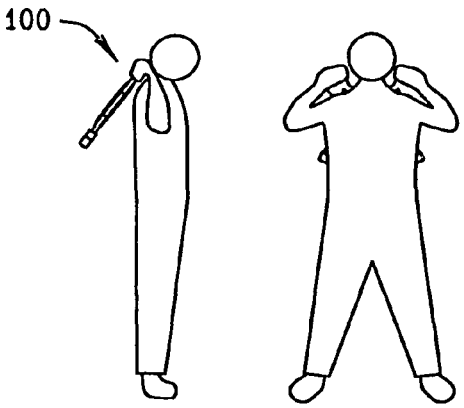
FIGS. 23A-23B are schematic views of an individual using the weight device for a physical fitness routine such as a triceps press exercise routine.
Figure 23B:
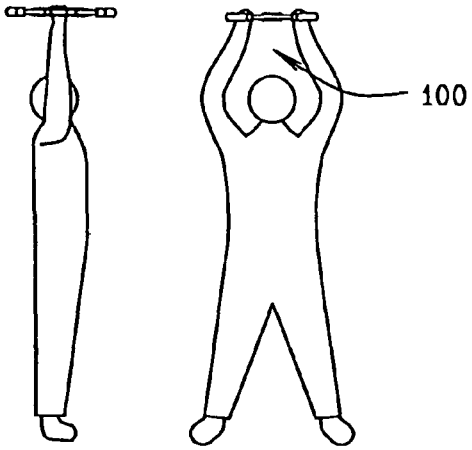

FIGS. 23A-23B show a triceps press exercise routine using the device 10. Initially, as shown in FIG. 23A, the handles 40 and 42 are grasped and the device 10 is placed behind the individual 100. Once in this position, the arms are extended upwardly and the device 10 is in an overhead position.

Figure 24A:
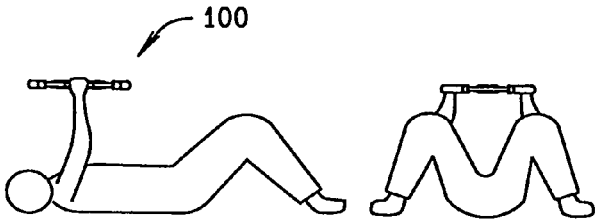
FIGS. 24A-24B are schematic views of an individual using the weight device for a physical fitness routine such as a triceps press exercise routine.
Figure 24B:
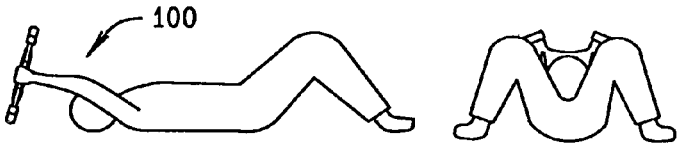

A variation of a triceps press exercise routine is depicted in FIGS. 24A-24B. In this routine, the back of the individual 100 is placed on the floor and the knees are bent. The device 10 is grasped by the handles 40 and 42 and the arms are extended upwardly away from the body. The device 10 is then lowered behind the head. To complete the exercise, the arms are then extended.

Figure 25A:
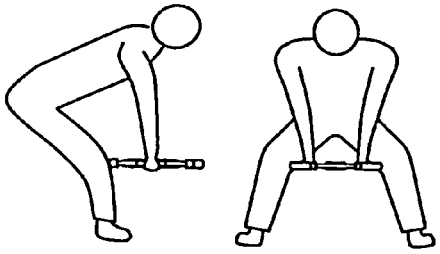
FIGS. 25A-25C are schematic views of an individual using the weight device for a physical fitness routine such as a power clean and press exercise routine.
Figure 25B:
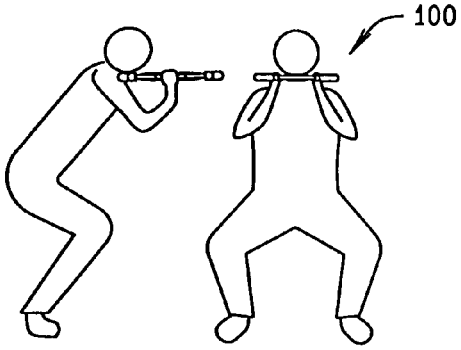
Figure 25C:
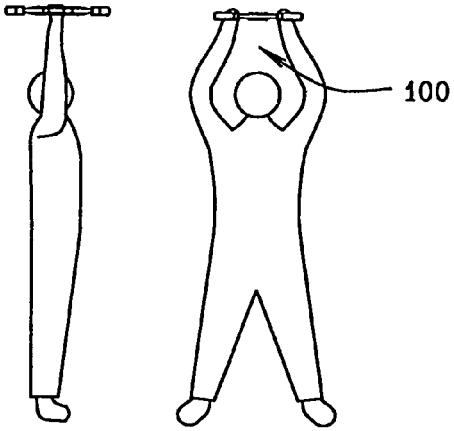

FIGS. 25A-25C show a power clean and press exercise routine. The individual 100 initially squats and grabs the device 10 by use of the handles 40 and 42 with the device almost touching the floor. The device 10 is then lifted in front of the individual 100 while still in the squat position. In a next step in the routine, at the same time, the individual 100 stands up straight and lifts the device 10 overhead.

Figure 26A:
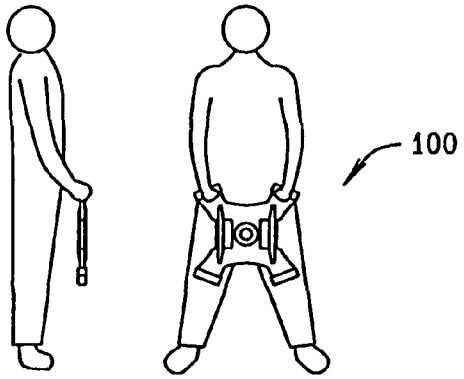
FIGS. 26A-26B are schematic views of an individual using the weight device for a physical fitness routine such as a curling exercise routine.
Figure 26B:
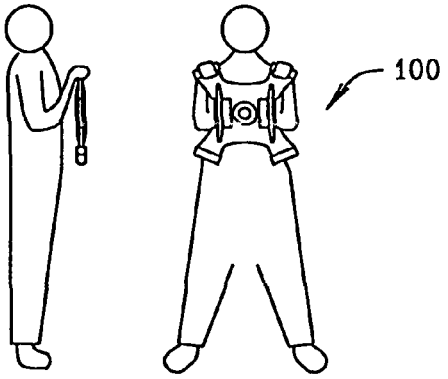

Referring now to FIGS. 26A-26B, a curling exercise routine is illustrated. The individual 100 initially is in an upright position with the arms fully extended downwardly while grasping the grips 20 and 26. The arms are then moved upwardly so that the device 10 is only chest high.

Figure 27A:
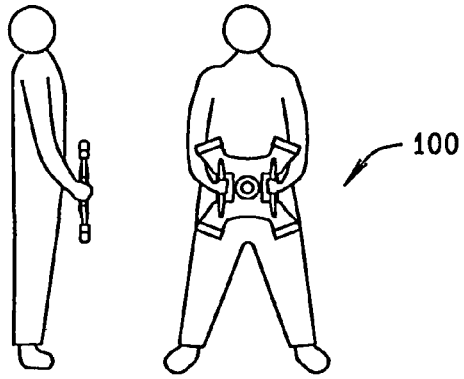
Figure 27B:
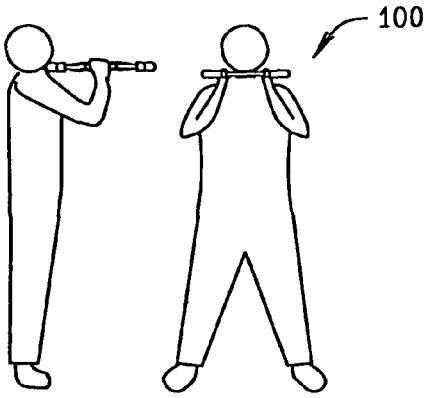

A second curling exercise is depicted in FIGS. 27A-27B. In this exercise, the individual 100 is in an upright position with the arms fully extended downwardly while grabbing the handles 40 and 42. The arms are then lifted upwardly to bring the device 10 in front of the face of the individual 100. The cutout section 48 allows the device 10 to be brought up to the face.

Figure 28A:
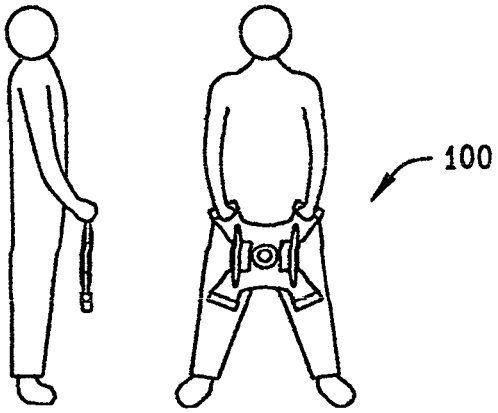
Figure 28B:
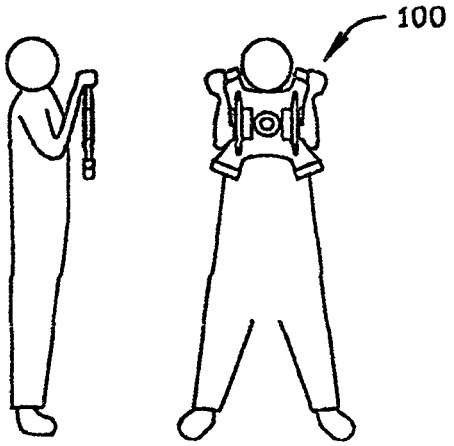

A third type of curling exercise is shown in FIGS. 28A-28B. In this particular exercise, the individual 100 is initially in an upright position, the arms are fully extended downwardly, and the device 10 is held at the grips 20 and 26. The device 10 is then brought up toward the face of the individual 100. To complete the exercise, the device 10 is lowered back in front of the individual 100 with the arms fully extended downwardly.

Figure 29A:
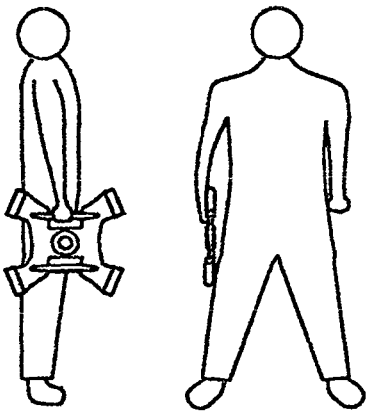
FIGS. 29A-29B are schematic views of an individual using the weight device for a physical fitness routine such as a curling exercise routine.
Figure 29B:
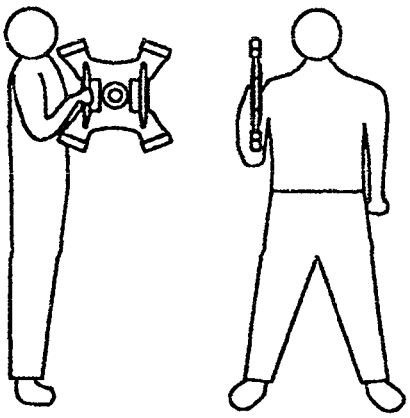

FIGS. 29A-29B show a fourth type of curling exercise. The device 10 is held in one hand by use of the handle 40 at the side of the individual 100. The device 10 is then moved upwardly by curling the arm. The device 10 is then brought back to the first position by moving the arm downwardly.

From a review of the variety of exercises that can be undertaken to perform the various physical fitness routines as disclosed, it has been determined that there are some 140 standard exercises that can be performed utilizing only the weight device of this invention. The invention, when used, encompasses most of the physical fitness routines that are normally performed at training facilities, but yet can be performed using the singular device of this invention.

From all that has been said, it will be clear that there has thus been shown and described herein a weight device for a physical fitness routine. It will become apparent to those skilled in the art, however, that many changes, modifications, variations, and other uses and applications of the subject weight device for a physical fitness routine are possible and contemplated. All changes, modifications, variations, and other uses and applications which do not depart from the spirit and scope of the disclosure are deemed to be covered by the disclosure, which is limited only by the claims which follow.

What is claimed is:

1. A weight device for performing multiple physical fitness routines comprising:

a plate having a generally H-shaped body including a first leg having an end having an integral hand grip portion, a second leg having an end having an integral hand grip portion, a third leg having an end having an integral hand grip portion, a fourth leg having an end having an integral hand grip portion, a first handle spanning between the first leg and the fourth leg, a second handle spanning between the second leg and the third leg, and a central portion for the weight device, a first cutout section formed between the first leg, the first handle, and the fourth leg, and said first cutout section opening exteriorly of said weight device, a second cutout section formed between the first leg and the second leg, and said second cutout section opening exteriorly said weight device, a third cutout section formed between the second leg, the second handle, and the third leg, and a third handle, and said third cutout section opening exteriorly of said weight device; and a fourth cutout section formed between the third leg and the fourth leg, and said fourth cutout section opening exteriorly of said weight device, whereby all of said cutout sections define an outer perimeter portion of the weight device and form clearance areas for a head, chin and arms of a user of said device during exercising.

2. The weight device of claim 1 wherein said central portion having a central bore therein, and said central bore is reinforced.

3. The weight device of claim 1 wherein the second leg is diametrically opposed to the fourth leg.

4. The weight device of claim 2 wherein the weight device is constructed of steel.

5. The weight device of claim 4 wherein the weight device is constructed of steel and a portion of the weight device is coated in plastic.

6. The weight device of claim 4 wherein the weight device is constructed of steel and a portion of the weight device is coated in rubber.

7. A weight device for a physical fitness routine comprising:

a plate having a generally H-shaped body including a first leg having an end having a first hand grip portion, a second leg having an end having a second hand grip portion, a third leg having an end having a third hand grip portion, a fourth leg having an end having a fourth hand grip portion, a first handle spanning between the first leg and the fourth leg, a second handle spanning between the second leg and the third leg, a central bore, a first cutout section formed between the first leg, the first handle, and the fourth leg, said first cutout section opening exteriorly of said weight device, a second cutout section formed between the first leg and the second leg, said second cutout section opening exteriorly of said weight device, a third cutout section formed between the second leg, the second handle, and the third leg, said third cutout section opening exteriorly of said weight device, and a fourth cutout section formed between the third leg and the fourth leg, and said fourth cutout section opening exteriorly of said weight device, all of said cutout sections opening exteriorly of said weight device and defining an outer perimeter portion of the weight device to provide selective clearance areas for a head, chin and arms of a user of said weight device during operating, the body having a first thickness and said hand grip portions having a second thickness with the second thickness being greater than the first thickness.

8. The weight device of claim 7 wherein said first hand grip portion, the second hand grip portion, the third hand grip portion, and the fourth hand grip portion each have the second thickness.

9. The weight device of claim 7 wherein the central bore is reinforced, and said bore provided for allowing the application of a bar of a barbell or a rod of a dumb bell to pass therethrough when adding weight to the weight device.

10. The weight device of claim 7 wherein the body has a front side, a back side, and the central bore has a first reinforcement member on the front side and a second reinforcement member on the back side.

11. The weight device of claim 7 wherein the first handle has a third thickness and the third thickness is greater than the first thickness.

12. The weight device of claim 7 wherein the second handle has a fourth thickness and the fourth thickness is greater than the first thickness.

13. A weight device for a physical fitness routine comprising:

a plate having a central portion including a first leg having an end having a first hand grip portion, a second leg having an end having a second hand grip portion, a third leg having an end having a third hand grip portion, a fourth leg having an end having a fourth hand grip portion, a first extension portion adjacent to the first leg, a second extension portion adjacent to the second leg, a third extension portion adjacent to the third leg, and a fourth extension portion adjacent to the fourth leg, and a central bore;

a first handle spanning between the first leg and the fourth leg;

a second handle spanning between the second leg and the third leg;

a first cutout section formed between the first leg, the first handle, and the fourth leg, a second cutout section formed between the first leg and the second leg, a third cutout section formed between the second leg, the second handle, and the third leg, and a fourth cutout section formed between the third leg and the fourth leg; said first, second, third, and fourth cutout sections all opening exteriorly of said weight device and defining an outer perimeter portion of the weight device to provide selective clearance areas for a head, chin and arms of a user of said weight device during exercising;

first hand cutout formed between the first handle, the first extension portion, the central portion, and the fourth extension portion; and a second hand cutout formed between the second handle, the second extension portion, the central portion, and the third extension portion.

14. The weight device of claim 13 wherein the central bore is reinforced.

15. The weight device of claim 13 wherein the first leg is diametrically opposed to the third leg.

16. The weight device of claim 13 wherein the second leg is diametrically opposed to the fourth leg.

17. The weight device of claim 13 wherein the first cutout section is generally rectangular in shape.

18. The weight device of claim 13 wherein the second cutout section is generally rectangular in shape.

19. The weight device of claim 13 wherein the weight device is constructed of steel and a portion of the weight device is coated in a colored rubber with the color of the rubber being used to indicate a weight of the weight device.

* * * * *